US006515565B1

(12) United States Patent
Muramatsu et al.

(10) Patent No.: US 6,515,565 B1
(45) Date of Patent: Feb. 4, 2003

(54) ELECTROMAGNETIC DEVICE EQUIPPED WITH SOLENOID, AUTOMATIC PLAYER USING THE SAME AND AUTOMATIC PLAYER KEYBOARD MUSICAL INSTRUMENT

(75) Inventors: Shigeru Muramatsu, Shizuoka (JP); Tadaharu Kato, Shizuoka (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 09/618,776

(22) Filed: Jul. 18, 2000

(30) Foreign Application Priority Data

Jul. 22, 1999 (JP) ..... 11-207329

(51) Int. Cl.[7] ..... H01F 27/02; H01F 15/10

(52) U.S. Cl. ..... 335/299; 335/282; 336/107; 336/292

(58) Field of Search ..... 335/282, 299; 336/107, 192, 198

(56) References Cited

U.S. PATENT DOCUMENTS 4,954,801 A * 9/1990 Urbanski et al. ..... 336/90
5,044,977 A * 9/1991 Vindigni ..... 439/374
5,111,175 A * 5/1992 Sugiura et al. ..... 336/192
5,570,075 A * 10/1996 Krimmer et al. ..... 336/96
5,590,637 A * 1/1997 Motodate ..... 123/634

FOREIGN PATENT DOCUMENTS

JP 5-33504 4/1993

* cited by examiner

*Primary Examiner*—Ramon M. Barrera
(74) *Attorney, Agent, or Firm*—Dickstein, Shapiro, Morin & Oshinsky LLP.

(57) ABSTRACT

An electromagnetic device has a bobbin with collars projecting from a cylindrical body, L-shaped conductive pins partially embedded in the collar so that first end portions and second end portions respectively project from the side surface and the lower surface of the collar, an insulated wire wound on the cylindrical body and connected at both ends thereof to the first end portions, a plunger projectable from and retractable into the cylindrical body, a socket holder attached to the bobbin so as to prevent the first and second end portions from damage and a socket coupled to the socket holder for connecting a cable to the second end portions, thereby allowing a manufacturer to increase the turns of the coil without enlarging the bobbin.

10 Claims, 6 Drawing Sheets

ELECTROMAGNETIC DEVICE EQUIPPED WITH SOLENOID, AUTOMATIC PLAYER USING THE SAME AND AUTOMATIC PLAYER KEYBOARD MUSICAL INSTRUMENT

FIELD OF THE INVENTION

This invention relates to an electromagnetic device and, more particularly, to an electromagnetic device such as, for example, a solenoid-operated actuator appropriate for an automatic player incorporated in an automatic player keyboard musical instrument.

DESCRIPTION OF THE RELATED ART

An automatic player piano is a typical example of the automatic player keyboard musical instrument. The automatic player piano is the combination of an acoustic piano and the automatic player. The automatic player is broken down into an array of solenoid-operated key actuators and a controller. The array of solenoid-operated key actuator is mounted on a key bed, and is located under the rear portion of the keyboard. The controller sequentially interprets music data codes representative of a tune previously performed, and selectively supplies driving signals to the soleniod-operated key actuators. Then, the solenoid-operated key actuators sequentially project the plungers, and the plungers upwardly push the rear portions of the black/white keys. The black/white keys are sequentially moved without a fingering, and actuate the associated action mechanisms. The hammers are driven for rotation by the associated action mechanisms, and the hammers strike the associated sets of strings. Then, the sets of strings vibrate so as to generate acoustic piano tones alone, the tune. The gap between the key bed and the keyboard is so narrow that the manufacturer makes an effort to scale down the solenoid-operated key actuators without reduction of the electromagnetic force.

If the acoustic player piano is of the type controlling the plungers through a feedback loop, the plungers are associated with plunger sensors, respectively, and the plunger sensors supply feedback signals representative of the current velocity of the plungers to the controller. The controller estimates trajectories of the projecting plungers, and regulates the driving signals for controlling the plunger velocity. The plunger sensor is, by way of example, implemented by the combination of a magnet piece and a solenoid. The magnet piece is attached to the plunger, and is movable inside of the solenoid. While the magnetic piece is moving inside of the solenoid, current is electromagnetically generated. The feedback signal is produced from the current. Thus, the solenoid-operated key actuators are indispensable components of the automatic player and, accordingly, the acoustic player keyboard musical instrument.

FIG. 1 illustrates the prior art solenoid-operated key actuator. The prior art solenoid-operated key actuator comprises a solenoid and a plunger (not shown). T he solenoid is broken down into following p arts. Collars and a cylindrical body form a bobbin 1. The collars are attached to both ends of the cylindrical body, and an insulated wire 2 is wound on the cylindrical body. The insulated wire 1 is covered with insulating tape 3, and both end portions of the insulated wire 2 are taken out through the insulating tape 3. A lead mount 5 is adhered to the insulating tape 3, and lead wires 4 are soldered to the insulated wire 2 on the lead mount 5.

Another prior art solenoid is different in coupling structure from the above-described prior art solenoid. Conductive terminals are fixed to both ends of the insulated wire, and the lead wires are connected to the conductive terminals. The junctions between the conductive terminals and the lead wires are inserted into heat shrinkable tubes, and, thereafter, head is applied to the heat shrinkable tubes. Then, the tubes are shrunk, and the junctions are tightly wrapped in the tubes.

Problems are encountered in the two kinds of prior art solenoids as follows. First, the prior art solenoid of the type having the insulated wire 2 soldered on the lead mount 5 is bulky and costly. The problems are reasoned as follows. As described hereinbefore, the manufacturer has been making the effort to scale down the solenoid-operated key actuator without reduction in electromagnetic force. The electromagnetic force is varied with the number of turns of the insulated wire 2. In other words, the manufacturer does not want to reduce the number of turns, and the insulated wire 2 occupies basic space around the bobbin 1. The prior art soleniod-operated key actuator shown in FIG. 1 further requires additional space around the basic space, because the insulating tape 3 is wound on the insulated wire 2 and the lead mount 5 is adhered to the insulating tape 3. The insulating tape 3 and the lead mount 5 increase the volume of the prior art solenoid, and the makes the prior art solenoid-operated key actuator bulky. The soldering step is required for the connection between the insulated wire 2 and the lead wires 4. The soldering is usually carried out by an assembling worker. The assembling worker is expected to solder the extremely small parts, i.e., the end portions of the insulated wire 2 and the lead wires 4. The soldering requires close attention, and a large amount of time and labor is consumed for the soldering. The production cost is increased due to the low throughput, and the prior art solenoid-operated key actuator is costly. Thus, the insulating tape 3 and the lead mount 5 makes the prior art solenoid bulky, and the soldering increases the production cost.

The prior art solenoid-operated key actuator of the type using the heat shrinkable tubes is also bulky and costly. The shrunk tube is less reliable, and an insulating sheet is required between the tube and a yoke for perfect electrical isolation. This results in that the bulky prior art solenoid. Moreover, a large amount of time and labor is consumed in the insertion of the junctions into the heat shrinkable tubes and the application of heat. The throughput is low, and the production cost is increased. This results in the bulky and costly solenoid.

SUMMARY OF THE INVENTION

It is therefore an important object of the present invention to provide an electromagnetic device, which is compact and low in production cost.

It is also an important object of the present invention to provide an automatic player, which is equipped with the electromagnetic devices for an automatic performance without fingering.

It is another important object of the present invention to provide an automatic player keyboard musical instrument, in which the automatic player is installed for performing a tune on the keyboard without fingering.

In accordance with one aspect of the present invention, there is provided an electromagnetic device comprising a solenoid including a body formed of a non-magnetic material for providing a magnetic path to a magnetic field and having a closed curved surface, a first surface outside of a space around the closed curved surface and a second surface outside of the space and the first surface, conductive pins partially embedded in the body and having respective first end portions projecting from the first surface and respective second end portions projecting from the second surface and a coil formed on the closed curved surface so as to occupy the space and having both end portions electrically connected to the first end portions, respectively, an electric connector including a socket holder associated with the conductive pins and having a guard portion for preventing the first end portions and the second end portions from damage and a socket connected to a cable, coupled to and separated from the socket holder and having holes, and a member electromagnetically influenced in the magnetic field so as to give rise to relative motion between the solenoid and the member, wherein the second end portions of the conductive pins are inserted into the holes so as to be electrically connected to the cable when the socket is coupled to the socket holder.

In accordance with another aspect of the present invention, there is provided an automatic player for selectively actuating plural manipulators comprising plural solenoid-operated actuators respectively associated with the plural manipulators for actuating the associated manipulators, respectively, each of the plural solenoid-operated actuators including a solenoid including a body formed of a non-magnetic material for providing a magnetic path to a magnetic field and having a closed curved surface, a first surface outside of a space around the closed curved surface and a second surface outside of the space and the first surface, conductive pins partially embedded in the body and having respective first end portions projecting from the first surface and respective second end portions projecting from the second surface and a coil formed on the closed curved surface so as to occupy the space, having both end portions electrically connected to the first end portions, respectively and creating the magnetic field when electric current flows therethrough and a movable member associated with one of the plural manipulators and moved in the magnetic field for actuating the associated one of the plural manipulators, plural electric connectors respectively associated with the plural solenoid-operated actuators and each including a socket holder having a guard portion for preventing the first end portions and the second end portions from damage, and a socket connected to a cable, coupled to and separated from the socket holder and having holes, the second end portions of the conductive pins being inserted into the holes so as to be electrically connected to the cable when the socket is coupled to the socket holder, and a controlling system respectively connected through the cables to the plural electric connectors, and selectively supplying the current to the solenoids of the plural solenoid-operated actuators for actuating the associated manipulators with the movable members.

In accordance with yet another aspect of the present invention, there is provided an automatic playing keyboard musical instrument comprising plural keys independently moved for producing tones, and an automatic player including plural solenoid-operated key actuators respectively associated with the plural keys for actuating the associated keys, respectively, each of the plural solenoid-operated actuators including a solenoid including a body formed of a non-magnetic material for providing a magnetic path to a magnetic field and having a closed curved surface, a first surface outside of a space around the closed curved surface and a second surface outside of the space and the first surface, conductive pins partially embedded in the body and having respective first end portions projecting from the first surface and respective second end portions projecting from the second surface and a coil formed on the closed curved surface so as to occupy the space, having both end portions electrically connected to the first end portions, respectively and creating the magnetic field when electric current flows therethrough and a movable member associated with one of the plural manipulators and moved in the magnetic field for actuating the associated one of the plural manipulators, plural electric connectors respectively associated with the plural soleniod-operated key actuators, each of the plural electric connectors including a socket holder having a guard portion for preventing the first end portions and the second end portions from damage and a socket connected to a cable, coupled to and separated from the socket holder and having holes, the second end portions of the conductive pins being inserted into the holes so as to be electrically connected to the cable when the socket is coupled to the socket holder and a controlling system connected through the cables to the plural electric connectors and selectively supplying the current to the solenoids of the plural soleniod-operated actuators for actuating the associated keys with the movable members.

BRIEF DESCRIPTION OF THE DRAWINGS

The features and advantages of the solenoid-operated actuator, the automatic player and the automatic player keyboard musical instrument will be more clearly understood from the following description taken in conjunction with the accompanying drawings in which.

DESCRIPTION OF THE PREFERRED EMBODIMENTS

First Embodiment

Figure 2:
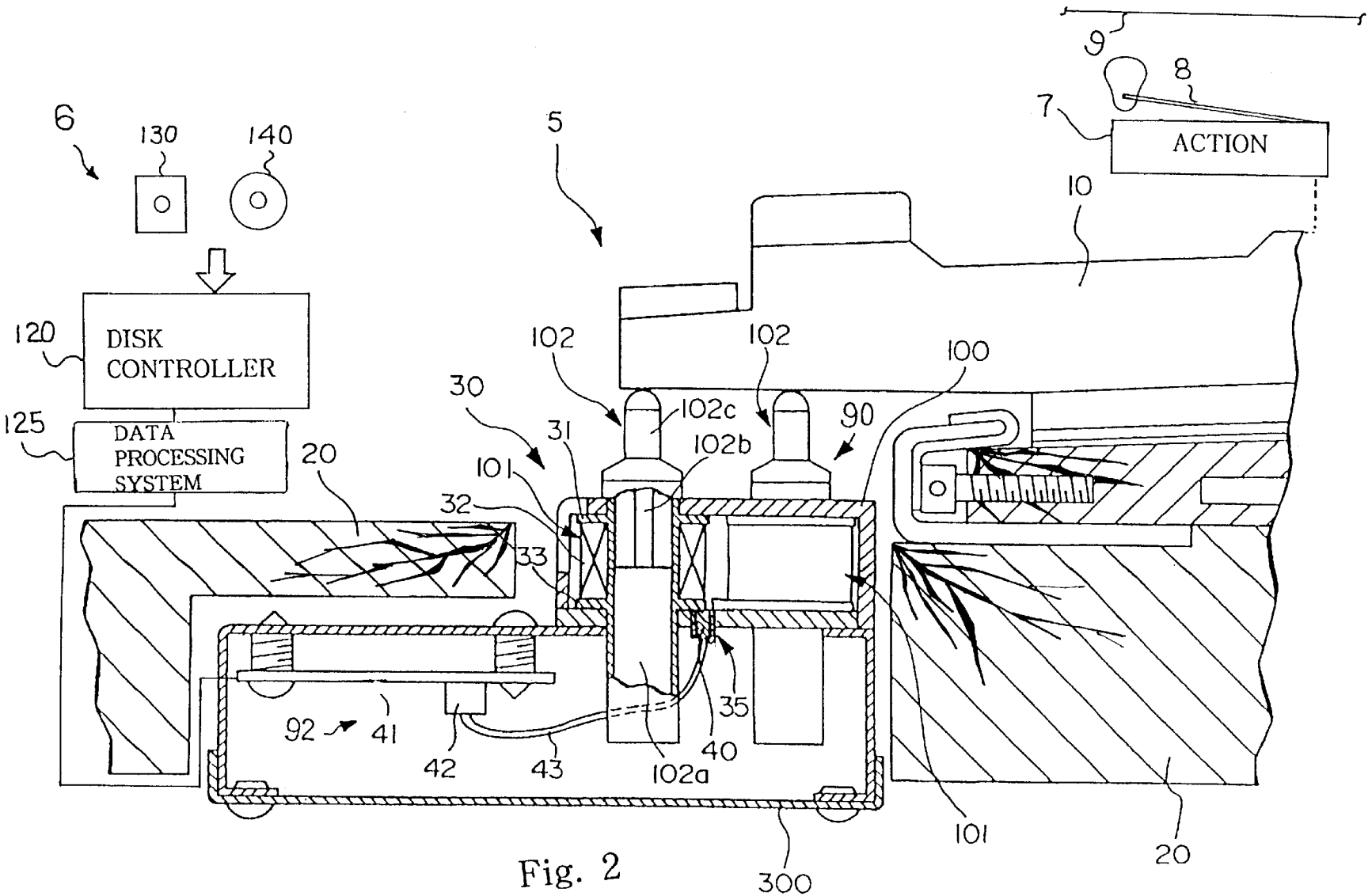
FIG. 2 is a cross sectional view showing the structure of an automatic player piano according to the present invention.

Referring to FIG. 2 of the drawings, an automatic player piano embodying the present invention largely comprises an acoustic piano 5 and an automatic player 6. In the following description, term "front" indicates a position closer to a person who plays a tune on the automatic player piano than a position modified with term "rear".

The acoustic piano 5 includes a keyboard 10, action mechanisms 7, hammers 8, sets of strings 9 and damper mechanisms (not shown). Plural black keys and plural white keys form in combination the keyboard 10, and are laid on the standard piano keyboard pattern. The keyboard 10 is mounted on a key bed 20, and the key bed 20 forms in combination a piano case together with other boards such as a side board, an upper beam and a desk rail.

The action mechanisms.7 are respectively linked with the black/white keys. When a black/white key is depressed by a human player, the depressed black/white key actuates the associated action mechanism 7 so as to slowly rotate the hammer 8 toward the set of strings 9. The depressed black/white key lifts up the damper, and renders the damper spaced from the associated set of strings. Thus, the set of strings 9 is ready for vibration before an escape from the hammer 8. When the jacks escape from the associated hammer 8, respectively, the hammers 8 are driven for rotation toward the associated sets of strings 9. The sets of strings 9 are stretched over the hammers 8, and are struck with the hammers 8, respectively. When a hammer 8 strikes the associated set of strings 9, the associated strings 9 vibrate for generating a piano tone. The hammer 8 rebounds on the set of strings 9. When the human player releases the depressed black/white key, the black/white key returns toward the rest position. Thus, the component parts 10, 7, 8 and 9 of the acoustic piano 5 behave as similar to those of a standard acoustic piano, and no further description is incorporated hereinbelow.

The automatic player 5 is broken down into an array of solenoid-operated key actuators 90, an electric circuit 41, a disk controller 120 and a data processing system 125. The array of solenoid-operated key actuators 90 is embedded in the key bed 20, and is located under the rear portions of the black/white keys. In detail, a yoke 100 is shared between the solenoid-operated key actuators 90. The solenoid-operated key actuators 90 are arranged in a staggered manner, and are fixed to the yoke 100. A slit is formed in the key bed 20, and is laterally elongated. The slit is open to both of the upper/lower surfaces of the key bed 20, and is under the rear end portions of the black/white keys. A recess is further formed in the key bed 20, and is open to only the lower surface of the key bed 20. The recess is contiguous to the lower portion of the slit. The bracket 300 defines a hollow space inside thereof, and the yoke 100 is attached to the front portion of the upper surface of the bracket 300. Thus, the yoke 100 and, accordingly, the solenoid-operated key actuators 30 project from the front portion of the bracket 300. The bracket 300 is provided in the recess and the lower portion of the slit, and is fixed to the key bed 20. The bracket 300 keeps the yoke 100 in the upper portion of the slit, and the solenoid-operated key actuators 30 partially projects from the slit toward the associated black/white keys, respectively.

The solenoid-operated key actuators 90 are similar in structure to one another, and are respectively associated with the plural black/white keys 10. Each of the solenoid-operated key actuators 90 largely comprises a solenoid 101 and a plunger 102. The plunger 102 is projectable from and retractable into the solenoid 101.

A bobbin 31, an insulated wire 32 and an insulating, tape (not shown) form the solenoid 30. The bobbin 31 is formed of non-magnetic electrically insulating material. In detail, the bobbin 31 has a generally cylindrical shape, and collars 33 project from the cylindrical body. At least the lower collar is formed of insulating material. The insulated wire 32 is wound on the cylindrical body of the bobbin 31, and form a coil 32*a*. The insulated wire 32 is covered with the insulating tape, and both end portions of the insulated wire 32 is taken out from the coil 32*a* through the insulating tape. When current flows the coil 32*a*, a magnetic field is created, and the yoke 100 provides a magnetic path.

The plunger 102 has a body 102*a*, a rod 102*b* and a plunger head 102*c*. The body 102*a* is integral with the rod 102*b*, and is slidably inserted into the inner space of the bobbin 31. The rod 102*b* partially projects from the solenoid 101, and the plunger head 102*c* is attached to the leading end of the rod 102*b*. The plunger heads 102*c* are held in contact with the rear portions of the black/white keys 10.

Figure 3:
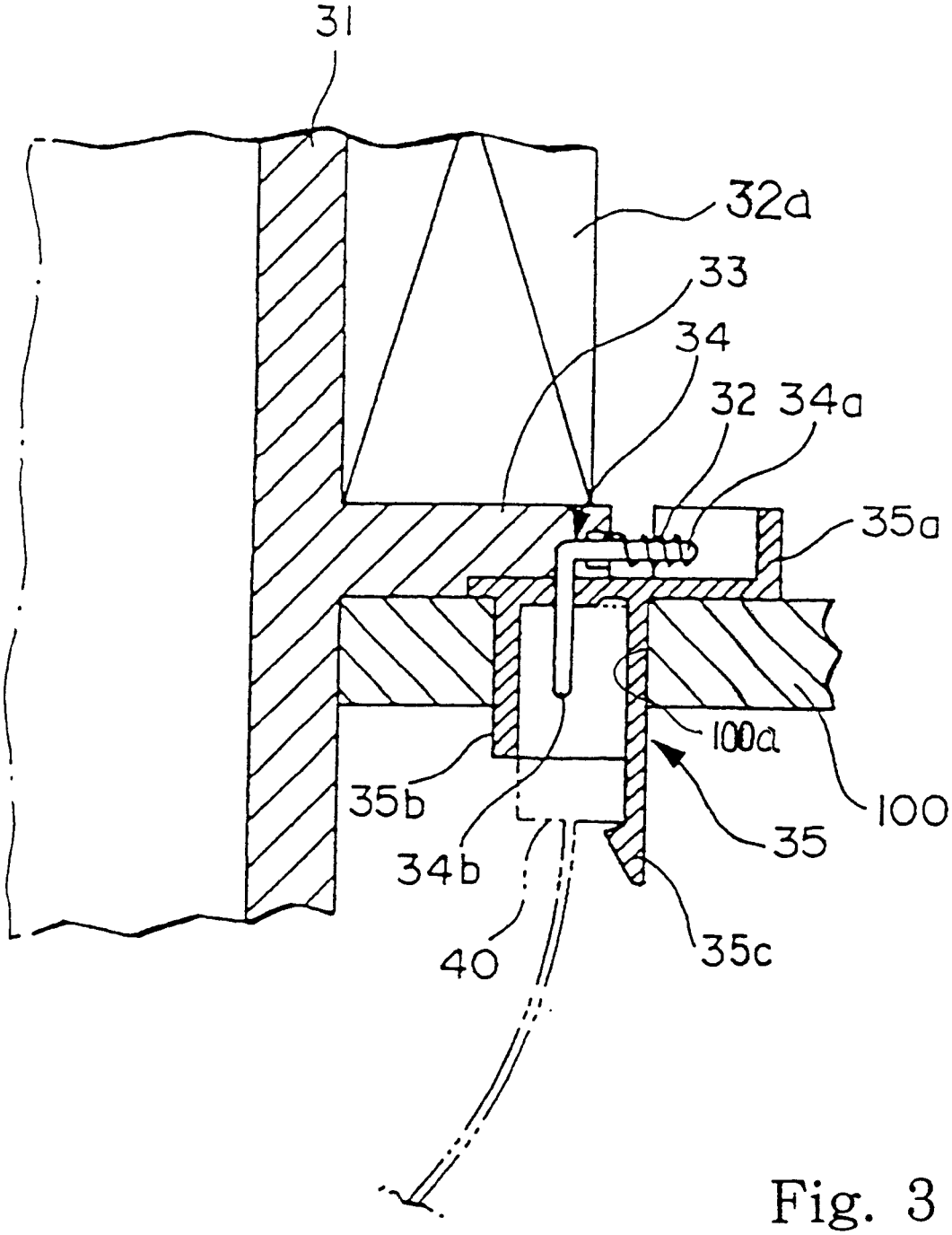
FIG. 3 is a cross sectional view showing an electric connector provided between a solenoid-operated key actuator and a cable.
Figure 4:
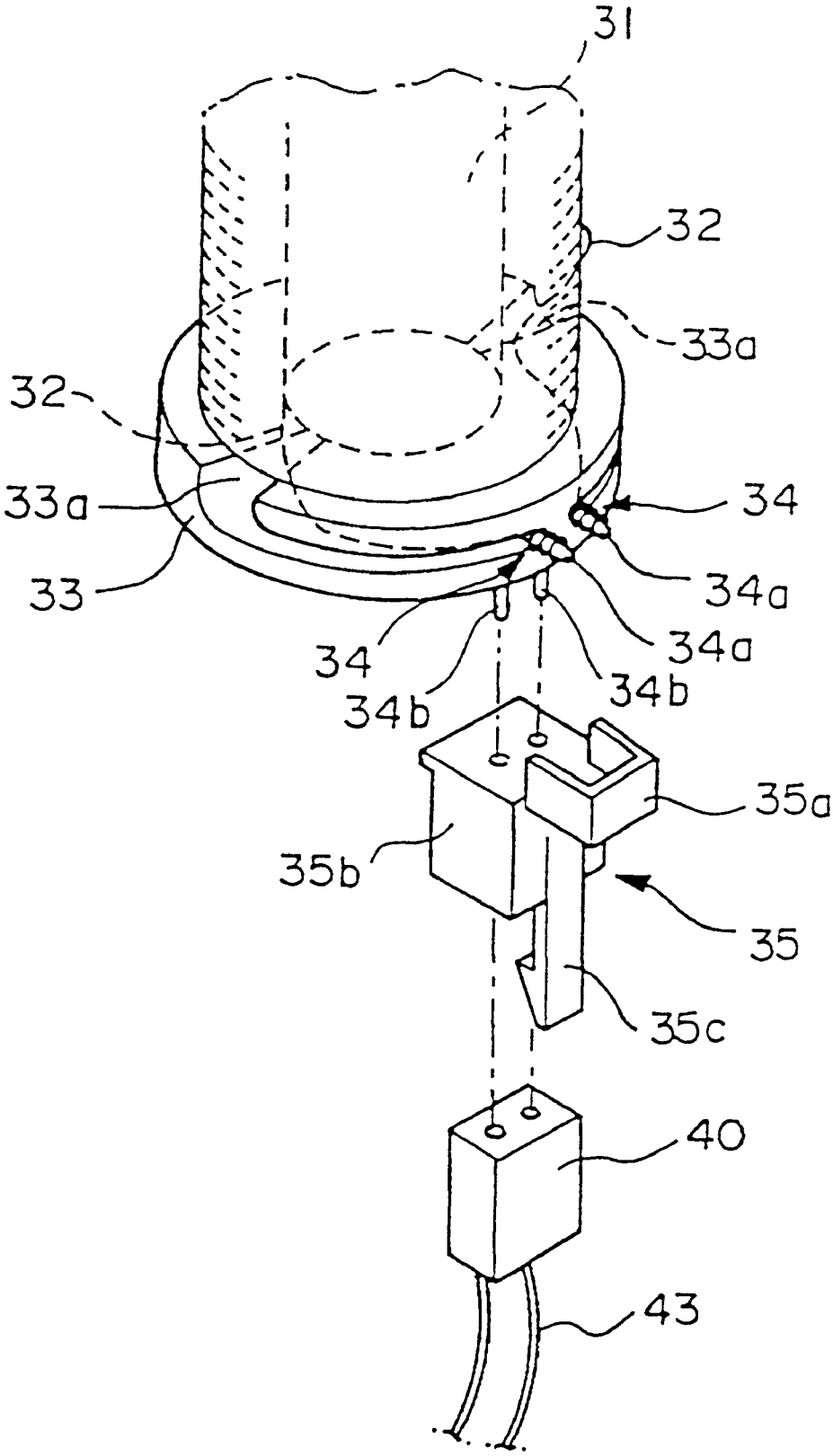
FIG. 4 is a fragmentary perspective view showing the electric connector.

The coil 32*a* is connected through a cable 43 to the electric circuit 92 as shown in FIGS. 3 and 4. A semicircular piece is cut away from the lower collar 33, and a semicircular depression 33*a* is left in the lower collar 33. As a result, a semicircular space takes place between the coil 32*a* and the lower collar 33. Two L-letter shaped conductive pins 34 are arranged in parallel to one another, and are partially embedded in the lower collar 33. Both end portions 34*a* and 34*b* of the L-letter shaped conductive pin 34 are respectively referred to as "connector" and "plug", respectively. The connectors 34*a* horizontally project from the side surface of the lower collar 33, and the plugs 34*b* downwardly project from the lower surface of the lower collar 33. The end portions of the insulated wire 32 pass through the semicircular space, and the connectors 34*a* are tangled with the end portions of the insulated wire 32. Thus, the current is applicable to the coil 32*a* through the L-shaped conductive pins 34.

An electric connector is inserted between the plugs 34*b* and the cable 43. The electric connector is broken down into a socket holder 35 and a socket 40. The socket holder 35 is formed of insulating material, and has a guard wall 35*a*, a box 35*b* and a hook 35*c*. The guard wall 35*a* aims at protection of the connectors 34*a*, and the box 35*b* aims at protection of the plugs 34*b*. Thus, the socket holder 35 protects the L-shaped conductive pins 34 against undesirable damage, and offers perfect electrical insulation between the yoke 100 and the coil 32*a* to the manufacturer. In fact, the electrical insulation between the yoke 100 and the coil 32*a* satisfies various safety standards in Japan.

Moreover, the electric connector, i.e., the socket holder 35 and the socket 40 permit the solenoid-operated key actuators 30 to generate large electromagnetic force, because the manufacturer increases the turns of the coil 32. The electric connector does not occupy the space to be assigned to each solenoid 101, but is located under the coil 32*a*. A narrow space is assigned to each solenoid 101, and is twice as wide as the black/white key at the maximum. If the electric connector is attached to the insulting tape wound on the outer surface of the coil such as the prior art lead mount 5, the narrow space is partially occupied by the electric connector, and the manufacturer decreases the turns of the coil so as to assign a part of the space to the electric connector. This results in reduction of electromagnetic force generated by the solenoid-operated key actuator. On the other hand, in case where the electric connector 35/40 is located outside the narrow space assigned to the coil 32*a*, the coil 32*a* fully occupies the narrow space, and the manufacturer increases the turns of the coil 32*a*. This results in large electromagnetic force, and the solenoid-operated key actuators 30 can reproduce the piano tone recorded at a strongly depressed black/white key.

A pair of through-holes is formed in the upper portion of the box 35*b*, and the holes of the pair are spaced from each other by a distance equal to that of the plugs 34*b*. A rectangular through-hole 100*a* is formed in the yoke 100, and the box 35*b* projects from the guard wall 35*a* through the rectangular through-hole 100*a* into the space under the yoke 100. The plugs 34*b* pass through the holes formed in the box 35*b*, and project into the box 35*b*. However, the rectangular through-hole 100*a* is too narrow to pass the guard wall 35*a* together with the box 35*b*. Accordingly, the guard wall 35*a* is placed on the yoke 100, and sidewardly projects from the upper portion of the box 35*b*. The connectors 34*a* are enclosed with the guard wall 35*a*, and the guard wall 35*a* prevents the connectors 34*a* from damage.

A hollow space is defined in the box 35*b*, and is open at the lower end thereof. The hook 35*c* downwardly projects from the box 35*b*, and a wedge is formed at the leading end portion thereof. The hook 35*c* is resiliently deformable, and the wedge inwardly projects into an access way under the hollow space. A pair of holes is formed in the upper portion of the socket 40, and the holes are spaced from each other by a distance equal to that of the plugs 34*b*.

Though not shown in the drawings, conductive clamps are provided inside of the socket 40, and are connected to the cable 43. The socket 40 has the dimensions corresponding to the hollow space in the box 35*b*, and the socket 40 is snugly insertable into the hollow space through the access way. When the box 40 is pushed into the hollow space of the box 35*b*, the lower surface of the socket 40 is caught by the wedge, and the hook 35*c* keeps the socket 40 in the hollow space. If the hook 35*c* is outwardly pushed, the wedge gets out of the place under the lower surface of the socket 40, and the socket 40 slips out from the box 35*b*. Moreover, the plugs 34*b* are inserted through the pair of holes into the conductive clamps in the socket 40, and the coil 32*a* is electrically connected through the L-shaped conductive pins 34 and the electric connector 35/40 to the cable 43. While an assembling worker is pushing the socket 40 into the box 35*b*, the socket 40 slides on the inner surface of the box 35*b*, and the box 35*b* makes the plugs 34*b* automatically aligned with the holes formed in the socket 40. Thus, the box 35*b* prevents the plugs 34*b* from damage.

In the assembling work, a worker simply pushes the sockets 40 into the associated socket holders 35. Thus, the electric connectors and the L-shaped conductive pins 34 make the assembling work simple. A solenoid-operated key actuator 30 is assumed to be damaged. The socket 40 is separated from the socket holder 35, and the bobbin 31 is taken out from the yoke 100 together with the L-shaped conductive pins 34. The defective soleniod-operated key actuator 30 is replaced with a new solenoid-operated key actuator 30. The plugs 34*b* project into the hollow space. The socket 40 is pushed into the box 35*b*, and the plugs 34*b* are automatically connected to the conductive clamps of the socket 40. Thus, the L-shaped conductive pins 34 and the electric connector 35/40 make the repairing work simple.

The electric circuit 92 is connected through the cable 43 and the electric connectors to the solenoids 101. The electric circuit 92 is integrated on a rigid circuit board 41, and includes solenoid driver circuits 42. The rigid circuit board 41 is accommodated in the bracket 300, and is bolted to the upper portion of the bracket 300. The solenoid driver circuits 42 are connected to the data processing system 125, and the disk controller 120 is also connected to the data processing system 125.

A disk driver or disk drivers are incorporated in the disk controller 120. A floppy disk 130 and a CD-ROM (Compact Disk Read Only Memory) 140 are insertable into a slot of the disk driver and loaded onto a tray of the other disk driver. A set of music data codes is recorded in the floppy disk 130 and the CD-ROM 140, and is representative of a performance on the keyboard 10 or another keyboard musical instrument. The disk controller 120 reads out the set of music data codes from the floppy disk 130 or the CD-ROM 140, and transfers the set of music data codes to a suitable memory such as, for example, a random access memory incorporated in the data processing system 125.

Though not shown in the drawings, the data processing system 125 further includes a central processing unit, a program memory, a signal interface and a shared bus connected to these component units. The disk controller 120 and the electric circuit 92 are connected through the signal interface to the shared bus. Computer programs are stored in the program memory, and selectively run on the central processing unit. The central processing unit achieves the tasks represented by the computer programs. One of the tasks is to store the music data codes in the random access memory. Another task is to increment an internal timer for a timer interruption. When the internal timer is indicative of the timing to execute a music data code, the central processing unit starts to execute a timer interruption sub-routine program so as to reproduce a piano tone.

Assuming now that the internal timer is indicative of one of the music data codes representative of a key-on event for producing the piano tone. The central processing unit analyzes the music data code, and determines the black/white key to be moved and the key velocity proportional to the loudness of the piano tone. The central processing unit produces the control signal representative of the key velocity, and supplies the control signal through the signal interface to the solenoid driver circuit 42 assigned to the black/white key to be moved. The solenoid driver circuit 42 is responsive to the control signal so as to determine the waveform of a driving signal. The driving signal is supplied from the solenoid driver circuit 42 through the cable 43 to the solenoid 101 of the associated solenoid-operated key actuator 30. The coil 32*a* is energized so as to create a magnetic field. Then, the plunger 102 is urged to project upwardly. The plunger head 102*c* pushes the rear end portion of the black/white key. The black/white key spaces the damper from the set of strings 9, and actuates the action mechanism 8 without any fingering. The hammer 8 is driven for rotation, and strikes the associated set of strings 9. The solenoid driver circuit 42 continuously applies the driving signal to the solenoid 101, and keeps the plunger 102 projecting from the soleniod 101.

When the internal timer is indicative of another music data code representative of a key-off event for decaying the piano tone. The central processing unit analyzes the music data code for an appropriate key trajectory. The central processing unit changes the control signal, and supplies it to the solenoid driver circuit 42. The solenoid driver circuit 42 determines the waveform of the driving signal. The solenoid driver circuit 42 starts to decay the driving signal before the timing to extinguish the piano tone. The plunger 102 is gradually retracted into the solenoid 101, and, accordingly, the rear end portion of the black/white key is sunk. The target trajectory guides the black/white key to pass a predetermined point at a time specified by the music data code. When the black/white key reaches the predetermined point, the damper is brought into contact with the set of strings 9 at the time, and decays the piano tone. Thus, the automatic player 6 sequentially moves the black/white keys along the tune, and reproduces the performance recorded in the floppy disk 130 or the CD-ROM 140.

Figure 5:
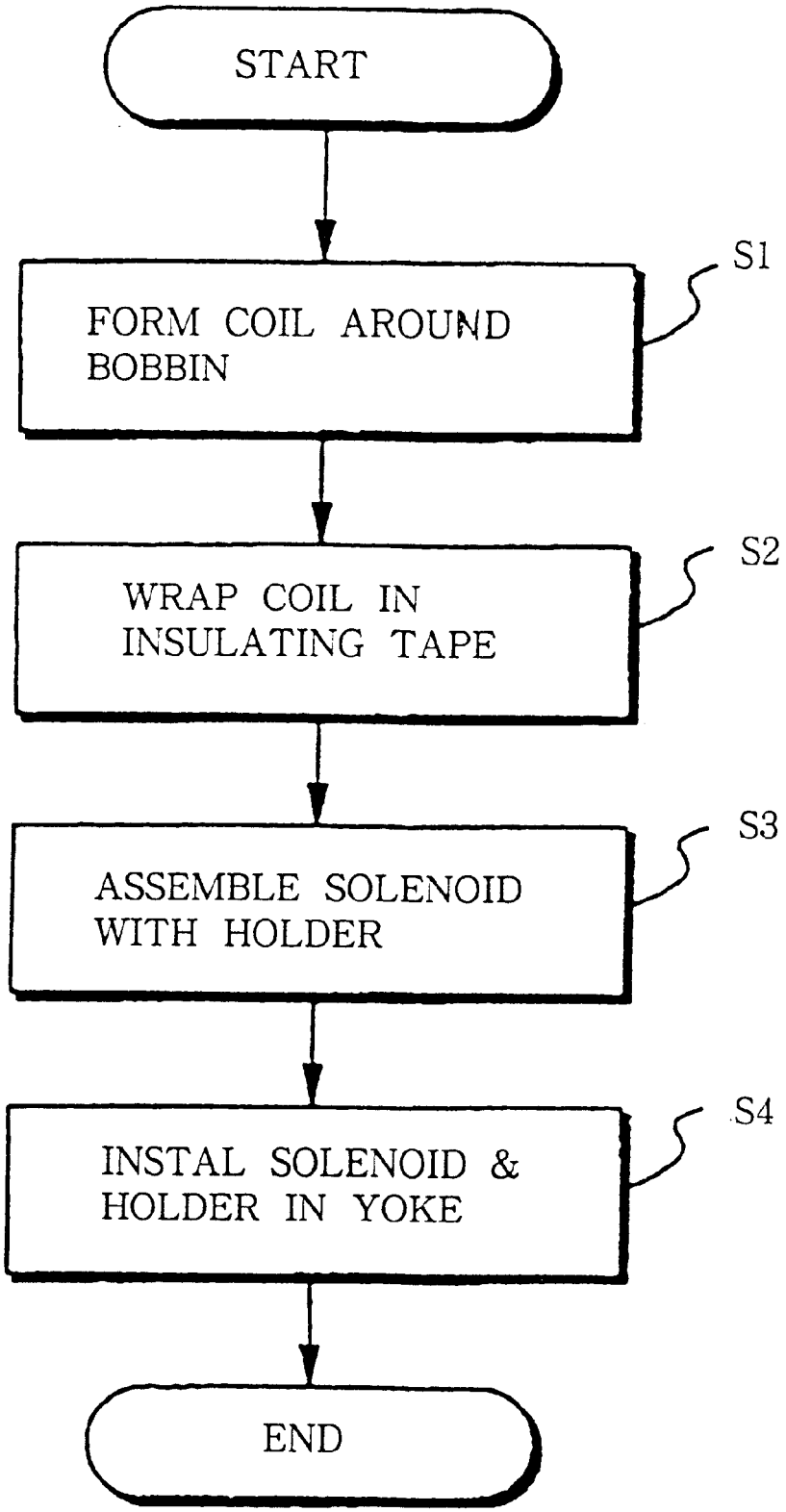
FIG. 5 is a flow chart showing a process for assembling the soleniod-operated key actuator.

The solenoid-operated key actuator is fabricated through a process shown in FIG. 5. The process starts with preparation of the bobbin 31. The Lshaped conductive pins 34 have been already embedded in the lower collar 33. Firstly, the coil 32*a* is formed around the bobbin 31 as by step S1. The bobbin 31 is attached to an automatic winding machine (not shown). One of the connectors 34*a* is tangled with one end portion of the insulated wire 32. The insulated wire 32 is wound on the cylindrical body of the bobbin 31. Thereafter, the other connector 34*a* is tangled with the other end portion of the insulated wire 32. Thus, the insulated wire 32 forms the coil 32*a* around the bobbin 31. The coil 32*a* is cut from the rest of the insulated wire 32, and the bobbin 31 is released from the automatic winding machine. Upon completion of the winding, the both end portions of the insulated wire 32 are soldered to the connectors 34*a*. The soldering may be manually carried out. Otherwise, an automatic soldering machine is used for the soldering.

Subsequently, the coil is wrapped in the insulating tape as by step S2, and the solenoid 101 is completed. A suitable wrapping machine is used for the solenoid 101.

Subsequently, the solenoid 101 is assembled with the socket holder 35 as by step S3, and the solenoid 101 and the socket holder 35 are installed in the yoke 100 as by step S4. The plugs 34 project from the yoke 100, and are enclosed inside the box 35*b*.

As will be understood from the foregoing description, the electric connector 35/40 is used for connecting the coil 32*a* to the cable 43. This means that the coil is neither directly soldered to nor tangled with the cable. The electric connector 35/40 is located out of the space around the bobbin 31, and the manufacturer is permitted to fill the space around the bobbin 31 with the coil 32*a*. The manufacturer makes the solenoid 101 compact without sacrifice of the electromagnetic force.

Moreover, the coil 32*a* is electrically connected to the cable 43 by means of the electric connector 35/40, and the connectors 34*a* are automatically tangled with both end portions of the coil 32*a*. The solenoid 101 is simply assembled with the socket holder 35. Thus, there is not any complicated step in the fabrication process. Most of the fabrication process is automated. This results in reduction of the production cost and standardization of the products.

Figure 1:
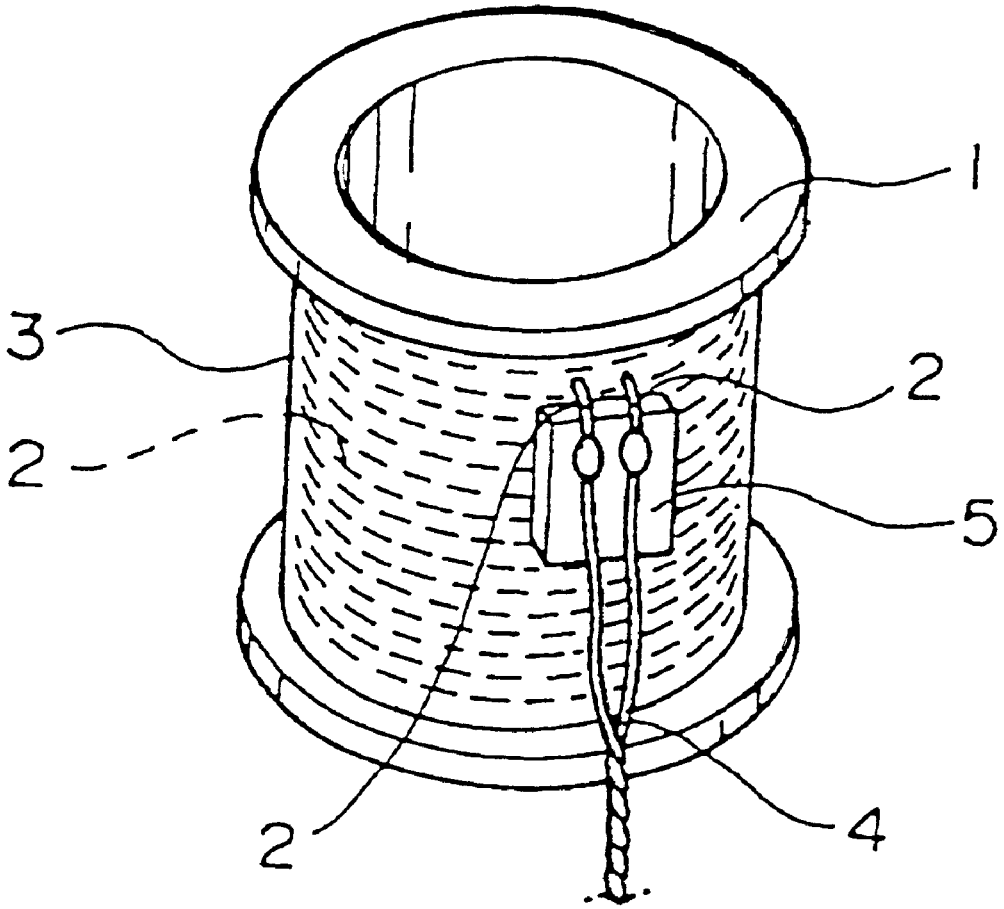
Fig. 1 PRIOR ART
FIG. 1 is a perspective view showing the structure of the prior art soleniod-operated key actuator.

Additionally, the solenoid-operated key actuators 30 are prevented from damage during the transportation. If the coil is fixed to the cable as shown in FIG. 1, the cable is liable to be separated from the coil due to, for example, vibrations during the transportation. As described hereinbefore, the socket 40 is easily pushed into and taken out from the socket holder 35. The manufacturer transports the products to a destination, and assembles the sockets 40 with the socket holders 35 after reaching the destination. Even though the vibrations are exerted on the socket holders 35 and the sockets 40 during the transportation, there is not any junction between the socket holders 35 and the sockets 40, and the electric connectors are free from the trouble during the transportation.

Finally, the electric connectors 35/40 make the assembling work between the coils 32*a* and the cables 43 easy, because the assembling worker simply pushes the sockets 40 into the socket holders 35. Although the slot formed in the key bed 20 is narrow, the assembling worker easily connects the coils 32*a* to the cables 43 by virtue of the electric connectors 35/40.

Second Embodiment

Figure 6:
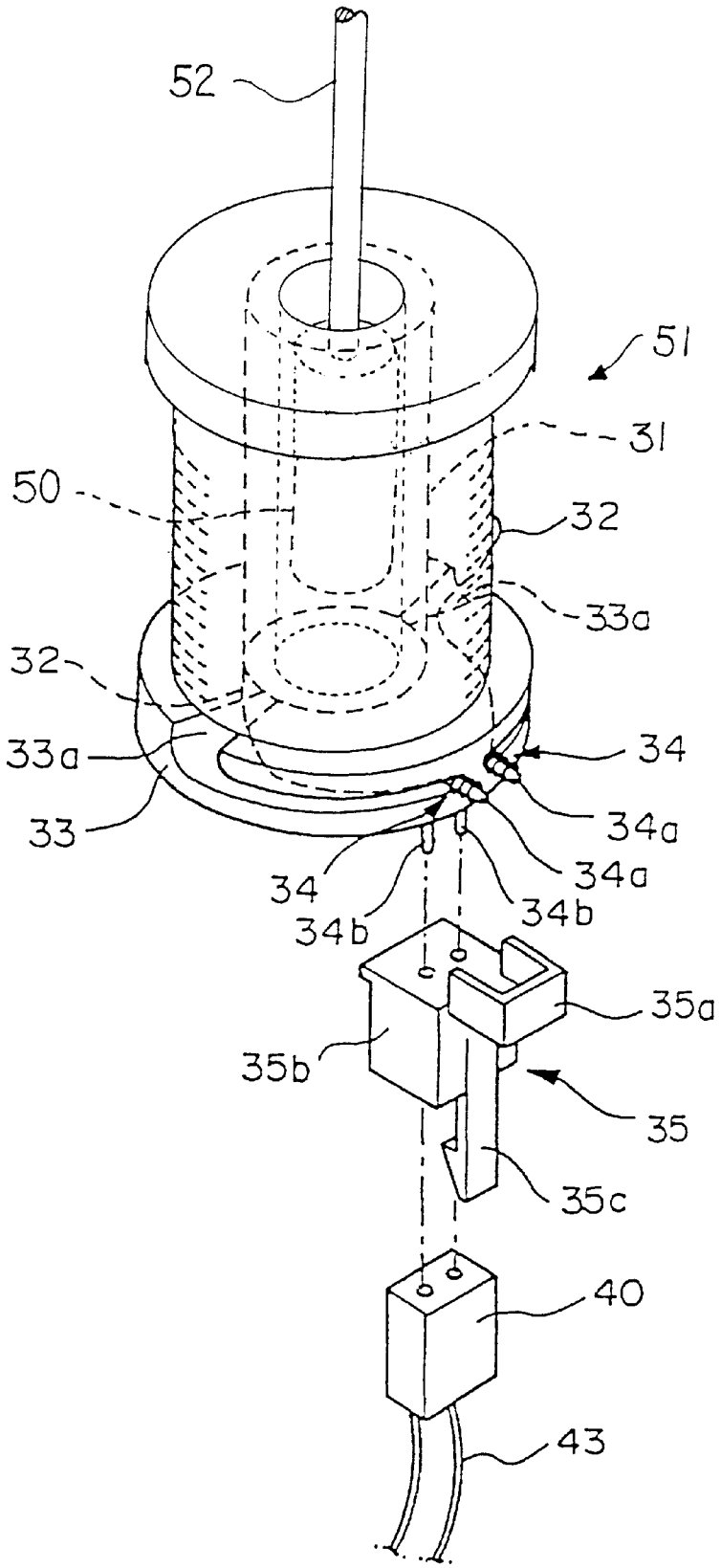
FIG. 6 is a fragmentary perspective view showing the structure of a velocity sensor according to the present invention.

Turning to FIG. 6 of the drawings, a velocity sensor embodying the present invention largely comprises a magnetic piece 50, a solenoid 51 and an electric connector. The solenoid 51 and the electric connector are similar to those of the first embodiment, and component parts are labeled with the same references designating corresponding parts of the solenoid-operated key actuator 30 and the corresponding parts of the electric connector incorporated in the first embodiment. The magnetic piece 50 is formed of magnetic material with a large magnetic permeability such as, for example, soft iron. The magnetic piece 50 is connected through a rod 52 to an object (not shown), and is inserted into a cylindrical space 53 inside of the bobbin 31. The magnetic piece 50 is movable in the cylindrical space in a direction of the center axis of the rod 52.

The object is assumed to move in the direction of the center axis. The rod 52 and the magnetic piece 50 are moved together with the object in the direction of the center axis. The relative motion takes place between the magnetic piece 50 and the solenoid 51. When electric current flows through the coil 32*a,* the magnetic piece SO is rapidly magnetized, and cuts the flux of the magnetic field. A potential difference is induced in the coil 32*a,* and the amount of current is varied. The current is taken out from the coil 32*a* through the electric connector 35/40 to the cable 43. The cable 43 may be connected to a data processing system. The potential difference is dependent on the extent of the relative motion, and the velocity of the object is estimated on the basis of the amount of current. When the electric current is removed form the coil 32*a,* the magnetic piece 50 is rapidly demagnetized.

The velocity sensor is available for any kind of moving object. The solenoid 51 is connected to the cable 43 by means of the electric connector 35/40. An operator easily joints the cable 43 to and separates the cable 43 from the solenoid 51 as similar to the solenoid-operated key actuator 30.

Although particular embodiments of the present invention have been shown and described, it will be apparent to those skilled in the art that various changes and modifications may be made without departing from the spirit and scope of the present invention.

For example, only one end portion of the insulated wire 32, which is led from the lower end of the coil 32*a,* may pass through the semicircular space 33*a*. In this instance, the other end portion of the insulated wire 32 extends on the insulating tape, and is would on the other connector 34*a*.

The socket holder 35 may have any other configuration in so far as the perfect electrical insulation and the protection against the damage are achieved. The socket holder 35 may be generally cylindrical corresponding to the socket. In this instance, a guide groove and a projection may be formed in the socket holder and the socket so as to make the plugs 34*b* and the conductive clamps automatically aligned.

The automatic player 6 may further have feedback loops for accurately controlling the plungers. A plunger position sensor forms a part of the feedback loop, and periodically reports the current plunger position to the central processing unit. The central processing unit checks a target trajectory of the plunger to see whether or not the plunger is exactly moved on the target trajectory. If the answer is negative, the central processing unit instructs the solenoid driver circuit to change the magnitude of the driving signal so as to change the plunger velocity. The plunger position sensors may be replaced with the velocity sensor shown in FIG. 6.

The set of music data codes may be supplied through a communication network such as, for example, an internet to the data processing system.

A recording system may be further incorporated in the automatic player piano so as to store a set of music data codes representative of a tune performed on the keyboard 10 in the floppy disk 130 or the rewritable compact disk. The set of music data codes may be supplied through the communication network.

The L-shaped conductive pins 34 and the electric connectors 35/40 are applicable to another solenoid forming a part of a velocity sensor or any kind of solenoid-operated actuator. The velocity sensor is the combination of the solenoid and a piece of magnet. The piece of magnet is attached to a moving object, and is moved inside of the coil. The piece of magnet generates the current flowing in the coil, and the amount of current is proportional to the velocity of the moving object. The current is taken out from the coil, and used as a velocity signal.

The electric connector may be located over the bobbin 31. For example, the L-shaped conductive pins 34 may be embedded in the upper collar. In this instance, the L-shaped conductive pins are also tangled with both end portions of the coil 32*a*.

The conductive pins are not limited to the L-letter shape. If both ends are exposed to a space outside of the space around the coil, the coil is connected at both ends thereof to the conductive pins without reduction of the turns. The configuration of the conductive pins is dependent on the location of the cable. For example, other conductive pins may have a U-letter shape, J-letter shape or an inverted V-letter shape.

The automatic player may be combined with another kind of musical instrument such as, for example, a window instrument. In this instance, the keys serve as manipulators.

What is claimed is:

1. An electromagnetic device comprising:

a solenoid including:

a body formed of a non-magnetic material for providing a path to a magnetic field having a closed curved surface, a first surface outside of a space around said closed curved surface and a second surface outside of said space and said first surface and projecting from both major surfaces of a yoke so that said second surface is on one of said major surfaces of said yoke, said yoke being formed with a hole open to said both major surfaces, conductive pins partially embedded in said body and having respective first end portions projecting from said first surface and respective second end portions projecting from said second surface into said hole, and a coil formed on said closed curved surface so as to occupy said space and having both end portions electrically connected to said first end portions, respectively, an electric connector including:

a socket holder associated with said conductive pins and having a guard portion passing through said hole, projecting from said both surfaces of said yoke for preventing said first end portions and said second end portions from damage and a hook projecting from said guard portion in a direction parallel to said second end portions and a socket connected to a cable, pushed into and pulled out from said socket holder for electrically connecting said cable to and disconnecting said cable from said coil and having holes, said hook keeping said socket in said socket holder when said socket is pushed into said socket holder, and a member electromagnetically influenced in said magnetic field so as to give rise to relative motion between said solenoid and said member, wherein said second end portions of said conductive pins are inserted into said holes so as to be electrically connected to said cable when said socket is pushed into said socket holder.

2. The electromagnetic device as set forth in claim 1, in which said member is movable in said magnetic field created by said coil when current flows therethrough.

3. The electromagnetic device as set forth in claim 1, in which said conductive pins are embedded in said at least one collar.

4. The electromagnetic device as set forth in claim 1, in which said socket holder has a box serving as said guard portion and having a hollow space open at one end thereof and permitting said second end portions to project thereinto, a guard wall formed on the other end of said box so as to enclose said first end portions and said hook resiliently deformable and projecting from said one end of said box into an access way contiguous to said hollow space, and said socket is insertable through said access way to said hollow space and caught by said hook when said socket is received in said hollow space.

5. The electromagnetic device as set forth in claim 4, in which said hollow space is same in configuration as said socket so that said box snugly receives said socket.

6. The electromagnetic device as set forth in claim 1, in which said member is a magnetic piece movable in said magnetic field, and said coil is within said magnetic field.

7. The electromagnetic device as set forth in claim 6, in which said magnetic piece is movable so as to induce a potential difference in said coil.

8. An electromagnetic device comprising:

a solenoid including:

a body formed of a non-magnetic material for providing a path to a magnetic field and having a bobbin which is provided with a closed curved surface;

at least one collar radially projecting from said closed curved surface and having a side surface which is spaced radially from said closed curved surface and a lower surface which extends below said side surface and said closed curved surface;

conductive pins partially embedded in said body and having respective first end portions projecting from said side surface and respective second end portions projecting from said lower surface; and a coil formed on said closed curved surface and having both end portions electrically connected to said first end portions, respectively, an electric connector including:

a socket holder associated with said conductive pins and having a guard portion for preventing said first end portions and said second end portions from damage;

a socket connected to a cable and removably coupled to said socket holder and having holes; and a member electromagnetically influenced in said magnetic field so as to give rise to relative motion between said solenoid and said member, wherein said second end portions of said conductive pins are inserted into said holes so as to be electrically connected to said cable when said socket is coupled to said socket holder.

9. The electromagnetic device set forth in 8, in which said conductive pins are embedded in said at least one collar.

10. The electromagnetic device as set forth in claim 8, in which said at least one collar has a depression open to an upper surface, which is opposite to said lower surface, so as to form a gap between said coil and said collar, and at least one of said both end portions of said coil is connected through said depression to one of said first end portions.

* * * * *